United States Patent [19]

Lagerstedt et al.

[11] 4,456,077

[45] Jun. 26, 1984

[54] DEVICE FOR RECIPROCATING MOTION OF A ROTATING DRILLING BODY OF A DRILLING MACHINE

[75] Inventors: Arne Lagerstedt; Eskil Lidstrand, both of Skärholmen, Sweden

[73] Assignee: Craelius AB, Marsta, Sweden

[21] Appl. No.: 373,618

[22] Filed: Apr. 30, 1982

[30] Foreign Application Priority Data

May 14, 1981 [SE] Sweden ..... 8103038

[51] Int. Cl.[3] ..... B23Q 5/027; B23Q 5/033

[52] U.S. Cl. ..... 173/147; 91/509; 91/531; 92/117 R

[58] Field of Search ..... 173/147, 151, 152; 91/509, 530, 531, 534, 519; 92/110, 117 R, 117 A

[56] References Cited

U.S. PATENT DOCUMENTS

| | | | |
|---|---|---|---|
| 3,089,550 | 5/1963 | Watson | 173/147 |
| 3,719,238 | 3/1973 | Campbell et al. | 173/147 |
| 3,744,578 | 7/1973 | Lisenby | 173/19 |
| 3,818,801 | 6/1974 | Kime | 91/519 |
| 3,835,940 | 9/1974 | Winter, Jr. | 173/147 |
| 4,033,468 | 7/1977 | Brown | 91/519 |
| 4,303,132 | 12/1981 | Weber | 173/147 |

*Primary Examiner*—Frank T. Yost
*Assistant Examiner*—Hien H. Phan
*Attorney, Agent, or Firm*—Barnes & Thornburg

[57] ABSTRACT

A device for reciprocating motion of a rotating drilling body of a drilling machine in the longitudinal direction of a hole drilled in rock or ground includes two cylinder-piston devices which via chains are connected to a carriage carrying the drilling body and which comprise parallel piston rods, the ends of which are supported by a frame on the machine, and cylinders movable along the piston rods and connected to each other and via the chains also to the carriage. To increase the feeding velocity of the carriage or to increase the force of the carriage one of the cylinders or both cylinders, respectively, are selectively fluid pressurized.

3 Claims, 3 Drawing Figures

DEVICE FOR RECIPROCATING MOTION OF A ROTATING DRILLING BODY OF A DRILLING MACHINE

DESCRIPTION

1. Technical Field

The present invention relates to a device for reciprocating motion of a rotating drilling body of a drilling machine in the longitudinal direction of a hole which is drilled in rock or ground.

2. Background Art

Drilling machines of this kind are previously known. A drilling machine known through U.S. Pat. No. 3,696,872 comprises a powered device consisting of a cylinder mounted in the drill frame and a piston movable in the cylinder and having a piston rod the free end of which is connected to a carriage via one or several chains which transfer the movement of the piston rod to this carriage.

Through U.S. Pat. Nos. 3,089,550 and 3,719,238 are known drilling machines each one of which is provided with a powered device including a fixed piston rod and a cylinder movable thereon which is connected to a drilling body via cables or the like.

Even though these devices function satisfactorily it is not possible to control the feeding velocity of the drilling body or the force to which the drilling body is subjected, namely so that the velocity will be increased when pulling a drilling rod out of a hole or inserting it in the hole or so that the force will be increased when the rod is pressed into material to be drilled (during drilling upwards) or when the rod is pulled out of the hole (after drilling downwards).

DISCLOSURE OF INVENTION

It is therefore an object of the present invention to provide a device by means of which a simple and reliable velocity and force control of the drilling body driven by the powered device is accomplished.

This object is fulfilled by the invention having the characteristics stated in the claims.

BEST MODE FOR CARRYING OUT THE INVENTION

Figure 1:
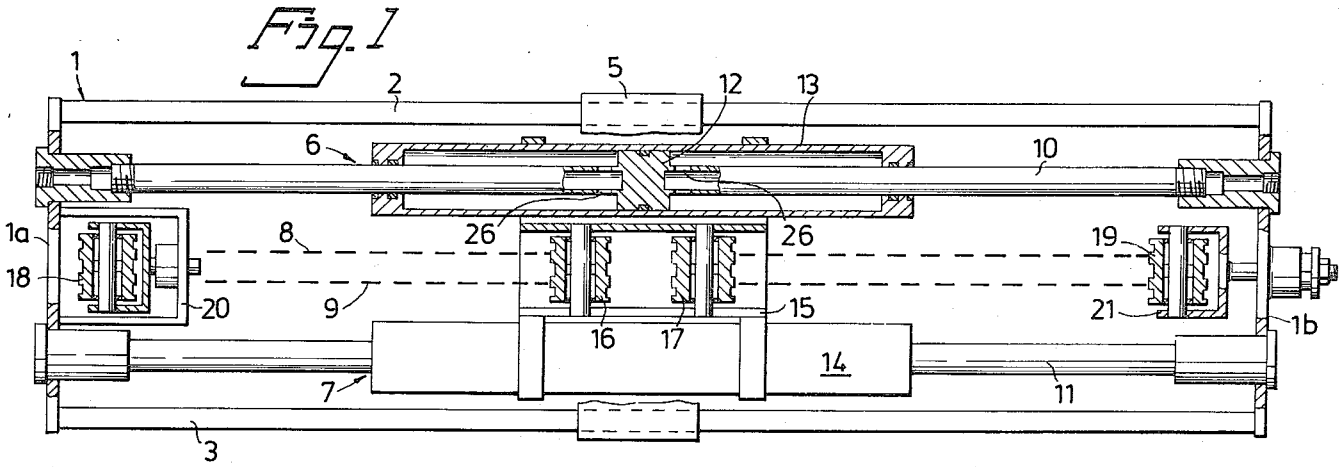
FIG.1 is a top view, partly in section, of a frame mounted to a drilling stand and including the device according to the invention.
Figure 2:
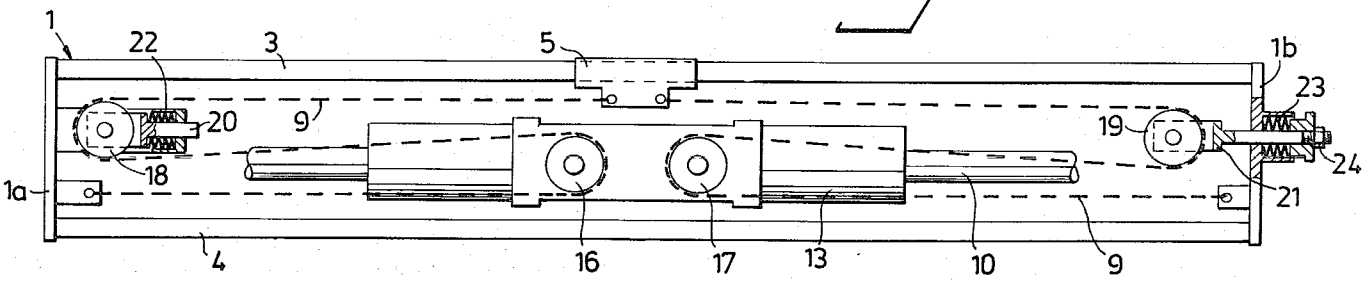
FIG. 2 is a side view, partly in section, of the frame and parts of the device according to FIG. 1.

The drilling machine with which the device according to the invention is used is a rock or ground drilling machine, for instance the machine marketed under the name DIAMEC (registered trademark) and to some extent described in the U.S. Pat. Nos. 3,565,187 and 3,696,872. A frame 1 is mounted to the stand of the drilling machine (not shown). This frame includes two opposing end walls 1*a* and 1*b* and a plurality of rods extending between these walls. Three of these rods 2, 3 and 4 are shown in FIGS. 1 and 2. Rods 2 and 3 support a carriage 5 which supports a drilling body (not shown). The drilling body clamps and rotates a drilling rod to form a hole in rock or ground. Carriage 5 is slidable along rods 2 and 3 and may be shifted forwards or backwards between its two end positions at the end walls 1*a* and 1*b*. In one direction the carriage, via the drilling body, inserts the drilling rod into the hole to be drilled and in the other direction it pulls the rod out from the hole.

Carriage 5 receives its reciprocating motion by means of two piston-cylinder devices 6 and 7 which are connected to the carriage via chains 8 and 9. Devices 6 and 7 are identical and each one includes a piston rod 10 and 11, respectively which is mounted between the end walls 1*a* and 1*b* so that it is subjected to tension forces, whereby its cross section can be made small even if the piston rod is long. Each piston rod has a piston 12. A cylinder 13 and 14, respectively sealingly encloses the piston 12 and a part of the piston rod 10 and 11, respectively. Cylinders 13 and 14 are connected to each other by a yoke 15 and are moved forwards and backwards on and along the piston rods 10 and 11 by feeding pressure fluid to the cylinders alternatingly to the right and to the left of the pistons.

Yoke 15 carries shafts on which chain wheels 16 and 17 are rotatably supported. The ends of the two identical parallel running chains 8 and 9 are secured to the walls 1*a* and 1*b*. The chains run on the wheels 16 and 17 and on wheels 18 and 19, rotatably carried by brackets 20 and 21 mounted on said walls, and are connected to the carriage 5. This is best shown in FIG. 2. When the cylinders are displaced a distance along the piston rods 10 and 11 the carriage 5 will be moved a distance twice as long by means of the above described arrangement of chains and wheels. To carry chain slack, especially arising when shifting the direction of motion of the cylinders 13, 14, the brackets 20 and 21 for the wheels 18 and 19 are actuated by pressure springs 22 and 23 which resiliently presses the wheels from each other. The tension of the chains 8 and 9 is controlled by engaging a nut 24 on a threaded portion of the bracket 21.

The operation of the device according to the invention will now be described mainly with reference to FIG. 3.

Via the hollow piston rods 10 and 11 fluid is fed to and from cylinders 13 and 14. For this purpose the walls of these rods are provided with holes 26 (FIG. 1) communicating with the inner space of the cylinders. Conduits 27, 28, 29 and 30 are connected to the outer ends of the piston rods 10 and 11. The conduits 27 and 28 are connected to a direction valve 31 which can be shifted from the shown central position, where the conduits 27, 28, are not subjected to fluid pressure, to a position either to the right, where the conduit 27 is set under pressure, i.e. is connected to a pump 32 and a fluid tank 33 and the conduit 28 acts as a return conduit, or to the left, where the conduit 28 is set under pressure and the conduit 27 acts as a return conduit. Thus, by controlling the valve 31 the cylinder 13 can be set under pressure so that it is moved to the left or to the right on the piston rod 10.

During the movement of the cylinder 13 it is possible to let the cylinder 14 run with the cylinder 13 without setting the cylinder 14 under fluid pressure whereby the whole fluid flow can be used to feed the cylinder 13. This means that the cylinders and the carriage 5 can be moved very rapidly which is utilized especially when pulling out the drill rod from the drilled hole and inserting it therein.

It is also possible to distribute the fluid pressure to both cylinders 13 and 14. In this manner the cylinders will be moved more slowly, but a force which is twice as strong as the force obtained if the flow is fed to the cylinder 13 only will be achieved. This is utilized especially when strong forces are necessary either to press the drill rod into the material to be drilled, when drilling is performed upwards, or to pull a long and heavy drill rod out from a drilled hole after drilling has been performed downwards.

Figure 3:
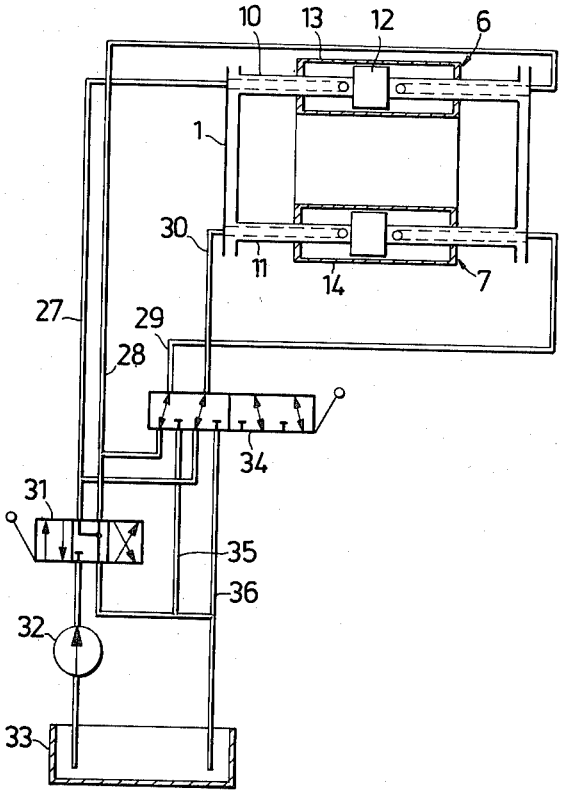
FIG. 3 is a flow diagram showing the operation of some parts of the device according to the invention.

To accomplish said run of the cylinder 14 with the cylinder 13 and said distribution of fluid pressure a valve 34 has been connected directly to the conduits 29 and 30, indirectly to the conduits 27 and 28 and indirectly to the valve 31 and the tank 33 in the manner shown in FIG. 3. When the valve 34 has been set to its end position to the right in FIG. 3 and the valve 31 has been set to its right or left end position the fluid pressure will be distributed uniformly to the cylinders 13 and 14. When the valve 31 has been set to any of the last mentioned positions and the valve 34 has been set to its end position to the left the conduits 29 and 30 are connected to conduits 35 and 36, which are connected to the valve 31 and the tank 33, whereby the cylinder 14 will not be subjected to any fluid pressure. Due to the conduits 29 and 30 being connected to the conduits 35 and 36 and thus are not directly "short-circuited" the fluid in the cylinder 14 will not be enclosed and overheated when the cylinder 14 runs with the cylinder 13 because the fluid in the cylinder 14 and in the conduits 29 and 30 will be exchanged continuously during the work of the cylinder 13.

Even though only one embodiment of the invention has been described above and shown in the drawings it should be understood that the invention is not limited to this embodiment but is only limited to what is stated in the claims.

We claim:

1. A device for reciprocating motion of a rotating drilling body of a drilling machine in the longitudinal direction of a drill hole, including at least two cylinder-piston devices comprising parallel piston rods, the ends of which are supported by a frame on the machine, and cylinders movable along the piston rods, at least one of the cylinders being connected to a carriage carrying the drilling body via at least one chain or the like, characterized by means mechanically connecting two or more of the cylinders together, by a valve controlled to selectively feed a predetermined fluid flow either simultaneously to all of said two or more cylinders mechanically connected to each other, whereby the drilling body will be subjected to a relatively strong force, or to a number of these cylinders less than all of the cylinders, whereby the drilling body will be moved relatively faster.

2. A device according to claim 1, characterized by a valve means which, when feeding the fluid flow to the cylinder or those cylinders the number of which being less than the total number of cylinders, connects the remaining cylinders to a fluid source preferably common to all cylinders.

3. A device according to claim 1 or 2, wherein one end of the chain or the like is connected to one end of the frame and the chain or the like is then trained respectively about or through a first wheel on the means mechanically connecting said two or more cylinders to each other, a third wheel adjacent said one end of the chain, the carriage, a fourth wheel connected to the opposing end of the frame, and a second wheel on the means mechanically connecting the cylinders to each other, and at last is connected to the opposing end of the frame, characterized by springs acting on the third and fourth wheels to reduce chain slack, one of the third and fourth wheels being adjustable to change the tension of the chain.

* * * * *